United States Patent [19]

Oxenrider

[11] 4,414,277

[45] Nov. 8, 1983

[54] MIXTURES COMPRISING FLUORINATED PYROMELLITATE OLIGOMERS USEFUL AS SURFACTANTS AND PROCESSES FOR THE PRODUCTION AND USE THEREOF

[75] Inventor: Bryce C. Oxenrider, Florham Park, N.J.

[73] Assignee: Allied Corporation, Morris Township, Morris County, N.J.

[21] Appl. No.: 412,620

[22] Filed: Aug. 30, 1982

[51] Int. Cl.[3] ..... B32B 27/34; B05D 3/02

[52] U.S. Cl. ..... 428/395; 252/8.9; 427/389.9; 427/393.1; 427/393.4; 428/267; 428/290; 428/365; 428/378; 528/296; 528/297; 528/299

[58] Field of Search ..... 428/267, 265, 260, 375, 428/290, 395, 378, 365; 427/389.9, 393.4, 393.1; 528/296, 297, 299; 252/8.9

[56] References Cited

U.S. PATENT DOCUMENTS

| | | | |
|---|---|---|---|
| 4,134,839 | 1/1979 | Marshall | 252/8.6 |
| 4,190,545 | 2/1980 | Marshall et al. | 252/8.75 |
| 4,192,754 | 3/1980 | Marshall et al. | 252/8.8 |
| 4,193,880 | 3/1980 | Marshall | 252/8.8 |
| 4,209,610 | 6/1980 | Mares et al. | 260/40 R |
| 4,252,982 | 2/1981 | Oxenrider | 560/87 |
| 4,264,484 | 4/1981 | Patel | 428/395 X |
| 4,283,292 | 8/1981 | Marshall et al. | 252/8.8 |
| 4,317,736 | 3/1982 | Marshall | 252/8.75 |
| 4,321,403 | 3/1982 | Oxenrider et al. | 560/87 |

OTHER PUBLICATIONS

Application of Thomas et al., Serial No. 350,344, filed Feb. 19, 1982.

*Primary Examiner*—Thurman K. Page

*Attorney, Agent, or Firm*—Kenneth E. Stroup; Alan M. Doernberg; Gerhard H. Fuchs

[57] ABSTRACT

A process for the production of oligomeric mixtures useful as surfactants is disclosed. The initial step of the process comprises reacting pyromellitic dianhydride with a fluoroalcohol using a mole ratio of about one mole pyromellitic dianhydride per two moles of fluoroalcohol to produce an intermediate which contains two fluorinated ester moieties and two free acid moieties. Thereafter, the intermediate diester-diacid is reacted with an excess of an oxirane compound such as epichlorohydrin, epibromohydrin or propylene oxide wherein said oxirane compound reacts with the free acid moieties to produce ester moieties containing a primary or secondary alcohol moiety. In the final step of the process, additional pyromellitic dianhydride is added to the reaction mixture so that the alcohol moieties may react with anhydride moieties to produce ester linking groups (between pyromellitate nuclei) and additional free acid moieties capable of reacting with the oxirane compound.

16 Claims, No Drawings

MIXTURES COMPRISING FLUORINATED PYROMELLITATE OLIGOMERS USEFUL AS SURFACTANTS AND PROCESSES FOR THE PRODUCTION AND USE THEREOF

BACKGROUND OF THE INVENTON

The present invention relates to a process for the production of highly effective surface treating agents. The surface treating agents produced in accordance with this invention comprise oligomeric mixtures containing pyromellitate nuclei. Many of the pyromellitate nuclei contain fluorinated ester moieties which impart water and oil repelling characteristics to various fibers.

U.S. Pat. No. 4,209,610 (Mares et al., 1980) discloses fluorinated pyromellitates useful as surface modifiers for polyamides and polyesters. One preferred group of compounds in that patent are those of the formula:

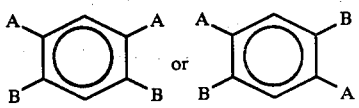

wherein A is a fluorinated ester such as $CF_3(CF_2)_pR'O(O)C$— and wherein B is $HOCH(CH_2Cl)CH_2O(O)C$—; wherein R′ is ethylene and p is a mixture of integers such as 3, 5, 7, 9 and 11 for different chains. Such products are formed by the reaction of pyromellitic dianhydride (PMDA) with a fluorinated alcohol, and then the reaction of the product diacid/diester with epichlorohydrin. Specifically, the product is produced by reaction of two moles of fluorinated alcohol with each mole of PMDA to form the diacid/diester. Each mole of the diacid/diester is then reacted with two moles of epichlorohydrin to produce the product. Because the oxirane may react at the one or two carbon, the product will normally contain minor amounts of material with B being $HOCH_2CH(CH_2Cl)O(O)C$— (the product with a pendant primary alcohol) as well as major amounts of material with B being $HOCH(CH_2Cl)CH_2O(O)C$— (the product with a pendant secondary alcohol). Other patents relating to the production of this product include U.S. Pat. No. 4,252,982 (Oxenrider 1981) wherein an ester solvent is used and U.S. Pat. No. 4,321,403 (Oxenrider et al., 1981) wherein N-methyl pyrrolidone is used as solvent. Methods for applying the compound in aqueous emulsions to fibers are disclosed in U.S. Pat. Nos. 4,192,754 (Marshall et al., 1980), 4,134,839 (Marshall, 1979), 4,190,545 (Marshall et al., 1980), 4,193,880 (1980), 4,283,292 (Marshall, 1981) and 4,317,736 (Marshall, 1982).

My copending, commonly assigned Application Ser. No. 380,188 describes a process for the production of pyromellitate oligomers useful as surface treating agents wherein a mole ratio of fluorinated alcohol to PMDA of less than 2:1 is employed.

The pyromellitate oligomers of the present invention have extremely high resistance to soiling, and soil resistant properties imparted to fibers by the oligomers of this invention are retained by the fibers after numerous laundering cycles. Therefore, fibers treated with the oligomers of the present invention will retain soil resistance properties for long periods of time in an environment where they are ultimately employed. Furthermore, as described in each of the above patents, an annealing step is employed after the application of the compound to the fiber. It would be desirable to be able to lower the temperature of the annealing step, for energy savings, without impairing either the initial soil resistance or the retention of soil resistance after laundering. With the oligomeric product mixtures of the present invention, the annealing step may be accomplished at temperatures as low as about 50° C.

BRIEF DESCRIPTION OF THE INVENTION

The present invention relates to novel oligomeric mixtures useful for the modification of surface properties and to a process for the production of the novel mixtures. Accordingly, the process of this invention comprises:

(a) reacting pyromellitic dianhydride with fluorinated alcohol at a mole ratio of about two moles of fluorinated alcohol per mole of pyromellitic dianhydride to produce a pyromellitate having two fluorinated ester moieties and two carboxylic acid moieties;

(b) reacting said pyromellitate of step (a) with an excess of an oxirane compound selected from the group consisting of epichlorohydrin, epibromohydrin, and propylene oxide in the presence of additional pyromellitic dianhydride to produce said organic mixture comprising oligomeric compounds; wherein said oxirane compound reacts with said carboxylic acid to produce an ester having a primary or secondary alcohol and wherein said alcohol reacts with said additional pyromellitic dianydride to produce ester linking moieties and carboxylic acid moieties capable of reacting with said oxirane compound to produce additional esters having primary or secondary alcohols.

The present invention further includes polyamide and polyester fibers having applied thereto the oligomer-containing mixtures described above. Finally, the present invention includes a process of applying the above oligomer-containing mixtures to fibers, with preferred annealing conditions for such process being between about 100° C. and about 140° C., although temperatures between about 40° C. and about 160° C. may be used.

DETAILED DESCRIPTION OF THE INVENTION

The process of the present invention utilized for the production of oligomer-containing mixtures employs three reactants. Pyromellitic dianhydride (PMDA) is one of the three reactants. Preferably, commercial grade pyromellitic dianhydride of greater than 98% purity should be employed for the practice of the present invention. Common impurities which can be tolerated in minor amounts include pyromellitic monoanhydride.

A second reactant is a fluorinated alcohol. While any alcohol having a relatively long chain of $CF_2$ groups with a terminal $CF_3$ group may be employed, the preferred fluorinated alcohols can be represented by the formula $CF_3(CF_2)_pR'OH$, wherein R′ is alkylene of 2–6 carbons, and p is an integer between 3 and 15, preferably between 3 and 13. In that formula R′ is preferably ethylene, 1,2-propylene or 1,4-butylene, and is most preferably ethylene. It is contemplated, and in fact preferred, to use a mixture of alcohols, particularly mixtures with the same R′ group such as ethylene, but with varying values for p. A representative commercial mixture of fluorinated alkyl ethanols has the formula $CF_3CF_2(CF_2CF_2)_nCH_2CH_2OH$ wherein n is, predominantly, 2, 3 and 4, with lesser amounts of n being 1 and 5, and traces only of n being 6 or 7.

A third reactant used in the present process is preferably epichlorohydrin. It may also be the corresponding bromo compound, known as epibromohydrin or propylene oxide. It will be appreciated that all three of these compounds are three carbon oxiranes with the third carbon being of the formula $CH_2X$ wherein X is Cl, Br or H.

The process of this invention may be conducted in any of the organic solvents utilized in forming the compounds of Mares et al., Oxenrider et al., or Oxenrider. Illustrative examples of useful solvents include dimethylformamide, N-methylpyrrolidone and aliphatic esters having a boiling point below about 150° C., such as methyl acetate, ethyl acetate, propyl acetate, etc. Other suitable solvents include aliphatic ketones such as methyl isobutyl ketone. The preferred solvent for the practice of this invention is N-methylpyrrolidone.

The order of reaction for the process of this invention is to initially react the fluorinated alcohol with pyromellitic dianhydride to produce a pyromellitate intermediate having two fluorinated ester moieties and two free acid moieties. The ratio of the reactants employed in the production of the diester-diacid intermediate should be about two moles of fluorinated alcohol per mole of pyromellitic dianhydride. This initial reaction may be conducted at temperatures between about 20° C. and about 80° C. with about 45° C. being the preferred temperature for this step of the process. The length of this initial reaction will range from about 2 hours to about 40 hours depending upon the reaction temperature and whether a catalyst such as triethylamine is employed. Higher reaction temperatures and catalysts will enhance the rate of the reaction and consequently, reduce the time required for the reaction to occur. The diester-diacid intermediate produced via the reaction of a mole ratio of fluorinated alcohol to pyromellitic dianhydride of 2:1 is the same intermediate produced in the above Mares et al., Oxenrider et al., and Oxenrider patents. The described first step of the process of this invention may be illustrated by reaction (1) as follows:

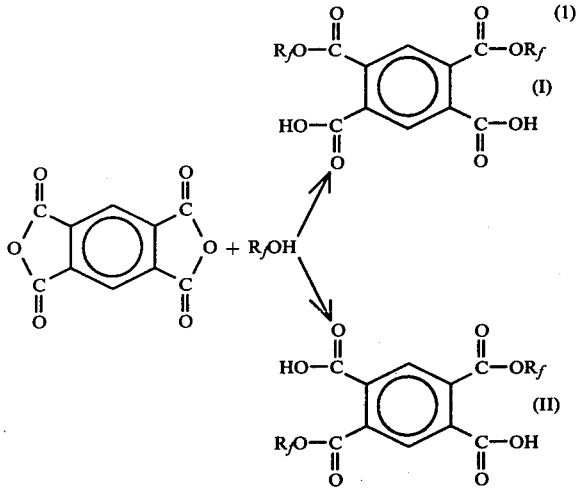

wherein $R_fOH$ is a fluorinated alcohol as described hereinbefore.

The diester-diacids represented by structures (I) and (II) above depict the meta and para isomers. It should be appreciated that the diester-diacid intermediate will actually constitute a mixture of the meta and para isomers. It is not necessary to isolate the diester-diacid before proceeding to the next step or steps of this invention. However, the diester-diacid could be isolated if it was desired to do so.

Following production of the diester-diacid intermediate, an excess of the third reactant, an oxirane compound as described above, is added to the reaction medium. The excess of oxirane employed will be more than 2 moles of oxirane compounds per mole of pyromellitic dianhydride utilized in the first step of the process. As will become apparent, the amount of excess of oxirane compound employed will depend somewhat upon the amount of pyromellitic dianhydride added to the reaction medium in a later step. The oxirane compound will react with the free acid moieties of the diester-diacid intermediate to produce a pyromellitate tetraester having two fluorinated ester moieties and two ester moieties having a primary or secondary alcohol. Production of the ester moiety having a primary or secondary alcohol results from the reaction of the oxirane compound at the 1 or 2 carbon with a free acid group. For example, reaction (2) below illustrates the reaction between epichlorohydrin and the diester-diacid intermediate.

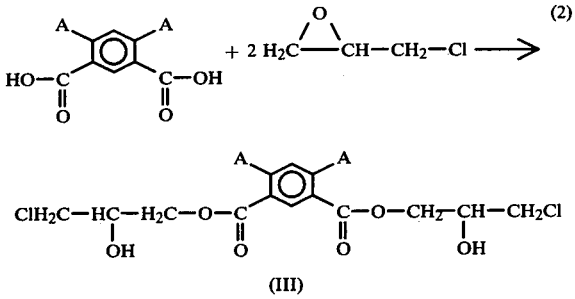

In reaction (2), A is a fluorinated ester moiety as previously described. In structure (III), the ester group containing the alcohol will now be referred to as B. Therefore, structure (III) may be illustrated as follows:

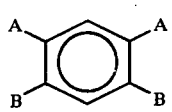

As previously stated, the para isomer of the diester-diacid intermediate is also formed. Therefore, structure (III) may also take the following form:

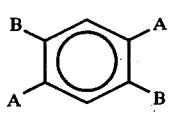

It should also be appreciated that if the oxirane compound reacts at the number 2 carbon, the B group will take the form of

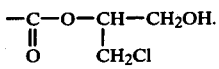

However, B groups having a primary alcohol are believed to represent only about 10% of the total number of B groups which are formed.

The reaction between the diester-diacid intermediate and the oxirane compound, reaction (2), should be conducted at a temperature between about 20° C. and about 90° C. with about 55° C. being the preferred temperature for this step of the invention.

The temperature for the second step will be that necessary to achieve the desired level of conversion (as measured by the disappearance of free carboxyl groups), such desired level being discussed below. Representative times for the second step are about 4 to about 20 hours, which may overlap with the third step as discussed below.

Reaction (2), the second step of the process, should preferably be conducted in the presence of a catalyst. Suitable catalysts include triethylamine, tributylamine, lutidene, pyridine and the like with triethylamine being the preferred catalyst for utilization in the process of this invention.

The next reaction necessary for the practice of the process of this invention involves the reaction of a B group primary or secondary alcohol of structure IV or V with an anhydride moiety of pyromellitic dianhydride. Reaction between said alcohol moieties and said anhydride moieties produces an ester linking group and a free acid group. This reaction may be illustrated as follows by the reaction of two pyromellitate tetraesters produced in accordance with this invention with a molecule of pyromellitic dianhydride:

tor reaction (2) by the disappearance of carboxyl groups via standard titration techniques and to add additional pyromellitic dianhydride to the reaction medium when about 50% to about 100% of the free acids have been esterified. It is especially preferred to add additional pyromellitic dianhydride to the reaction mixture when about 85% to 95% of the carboxyl groups have been esterified as determined by titration procedures.

As described, once excess pyromellitic dianhydride is added to the reaction medium, reaction (3) of the process of this invention will occur if ester groups having a primary or secondary alcohol (B groups) are present. Reaction (3) will occur at temperatures between about 20° C. and about 90° C. with about 55° C. being the preferred temperature for reaction (3). Completion of reaction (3) will be evidenced by the disappearance of essentially all unreacted carboxyl groups. The determination that essentially no unreacted carboxyl groups remain may be accomplished by standard titration procedures. The time required to complete reaction (3) will range from about 1 hour to about 40 hours, depending upon the reaction temperature, amount of additional pyromellitic dianhydride employed, etc. It is believed that higher temperatures for reaction (3) will drive the process to form higher oligomers than would be produced by lower reaction temperatures.

Examination of structure VI reveals that structure VI has four hydroxyl groups (1, 2, 3, and 4 as labeled)

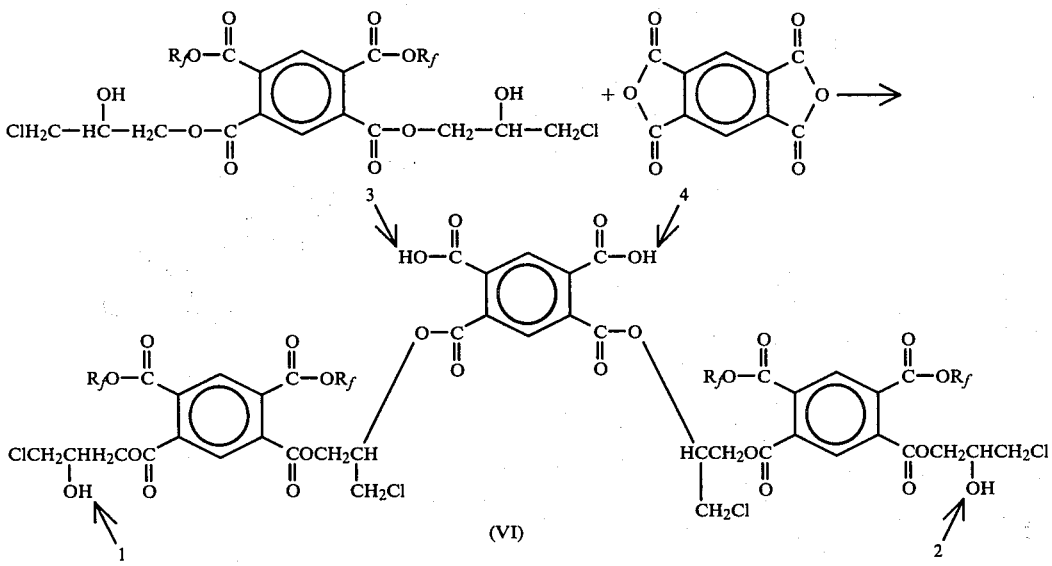

In order for reaction (3) to occur, additional pyromellitic dianhydride must be added to the reaction medium after the formation of the diester-diacid in reaction (1). The pyromellitic dianhydride may be added to the reaction medium simultaneously with the addition of the oxirane compound. When this procedure is followed, as soon as free acid groups are esterified by the oxirane compound thereby forming B groups containing a primary or secondary alcohol, the alcohol may react with an anhydride moiety in accordance with reaction (3) as described. It is especially preferred, however, to moniwhich are capable of undergoing a further reaction. Hydroxyls 1 and 2 are capable of reacting with an anhydride moiety of an unreacted pyromellitic dianhydride molecule to form additional ester linking groups and free acid groups. Hydroxyls 3 and 4 are capable of reacting with unreacted oxirane compound to form additional B groups having the B group structure previously described (i.e. ester groups having a primary or secondary alcohol). The organic structure formed by the reaction of the four hydroxyls of structure VI is a pentamer represented by structure VII as follows:

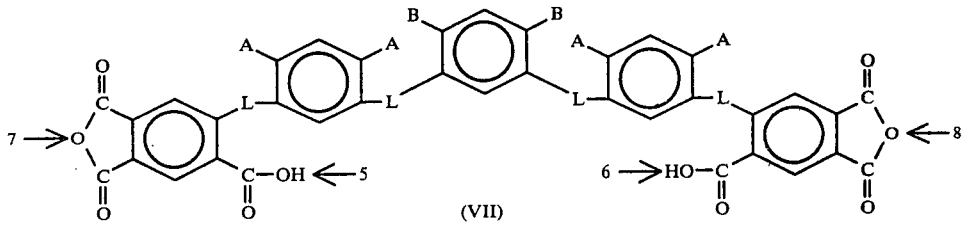

(VII)

wherein A and B are as previously described and L is an ester linking group having the following structure:

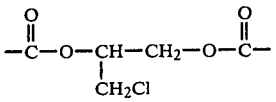

It should be appreciated that chlorine in the above structure could alternately be bromine or hydrogen if epibromohydrin or propylene oxide were to be employed in place of epichlorohydrin.

Structure VII contains two hydroxyls (5 and 6 as labeled) and two anhydride groups (7 and 8 as labeled). Hydroxyls 5 and 6 will react with the oxirane compound to produce additional B groups capable of reacting with another anhydride, and anhydrides 7 and 8 of structure VII will react with an alcohol from a B group of a fluorinated pyromellitate or a B group from another anhydride to form additional ester linking groups (L groups as described for structure VII).

It should be appreciated that structures VI and VII are intermediates in the oligomerization process because the oligomeric product mixture will contain essentially no unreacted acid or anhydride groups. The exact path the oligomerization process will travel is uncertain, and an undeterminable number of oligomeric species in an undeterminable ratio will inherently result in the oligomeric product mixture.

For illustrative purposes, structures VIII through XIII below represent oligomers which may be present in the oligomeric product mixture produced by the process of this invention. Structures VIII through XIII are intended to illustrate, but not to exhaust, the oligomeric components of the novel mixture produced by the process of this invention.

(VIII)

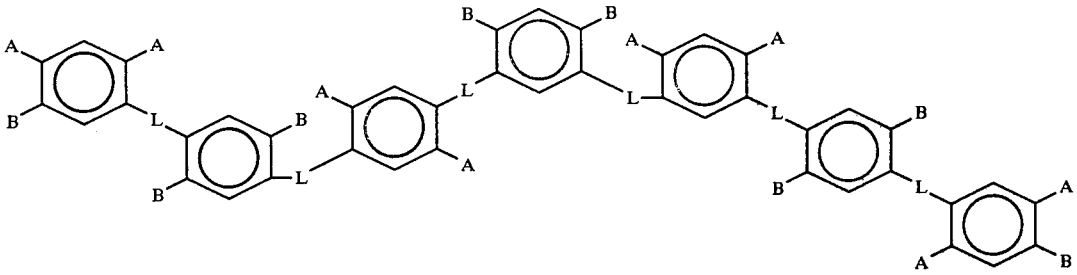

(IX)

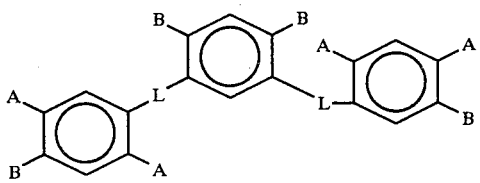

(X)

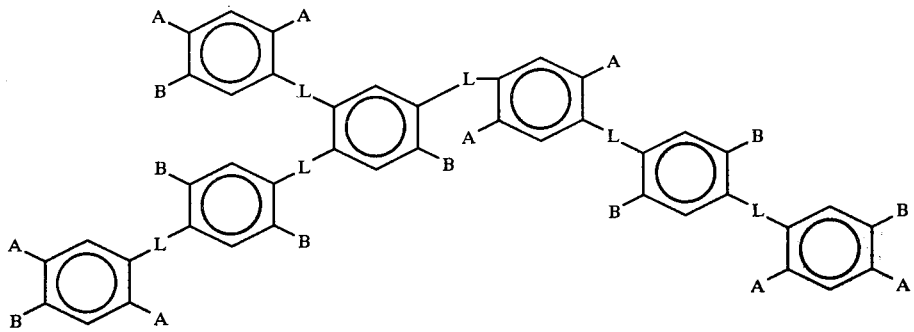

-continued

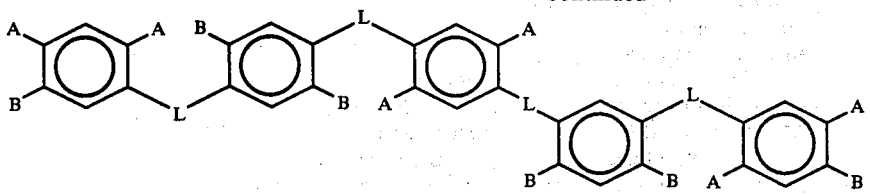

(XI)

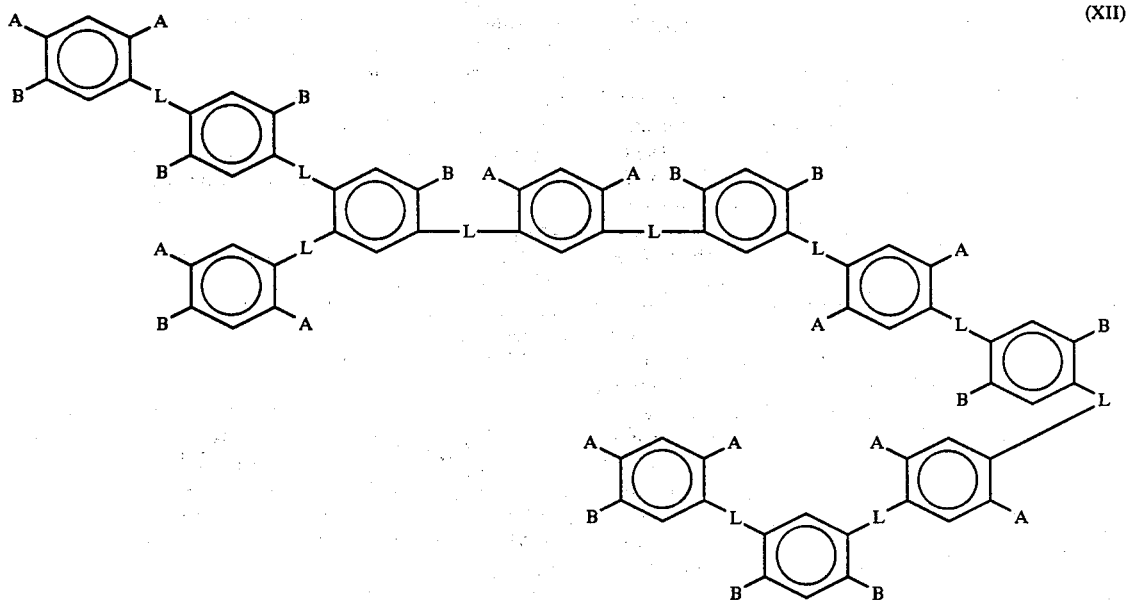

(XII)

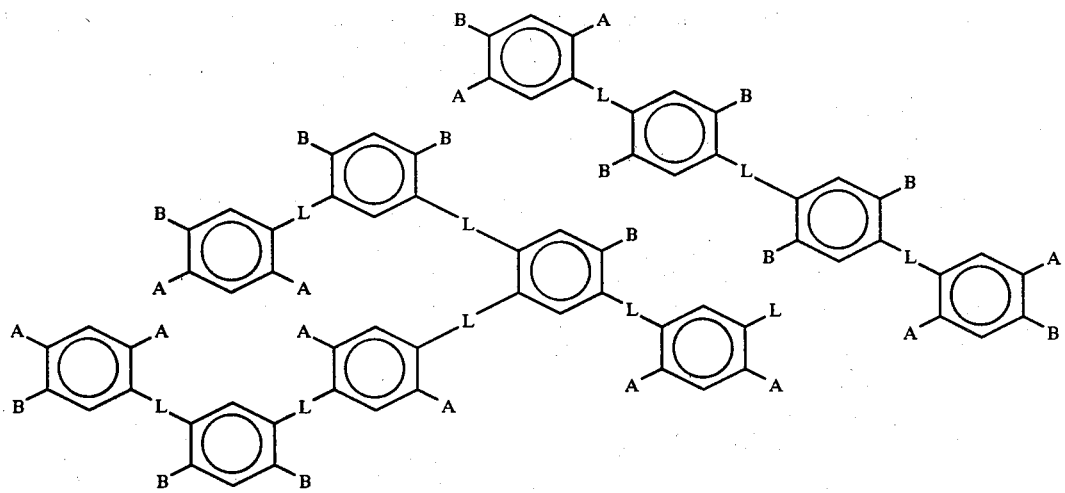

(XIII)

In structures VIII through XIII, A represents a fluorinated ester group as previously described; B represents an ester group having a primary or secondary alcohol as previously described; and L represents an ester linking group as previously described.

It is desirable to conduct the process of this invention in a dry atmosphere, as for example in the presence of dry nitrogen. Pressure is not critical, with atmospheric pressure being suitable. Solvent amounts are not critical, with sufficient solvent being enough to keep at least half of the pyromellitates and fluoroalcohols in solution (since precipitate can redissolve into solution as it reacts), and preferably all of the reactants, intermediates, and products in solution.

Once formed, the oligomer-containing mixtures of the present invention are normally recovered from the solvent in a manner analogous to that employed in the above Mares et al., Oxenrider et al. and Oxenrider patents. Thus, for example, the entire reaction mixture may be added to a non-solvent such as water when N-methylpyrrolidone is used as solvent, or a volatile ester or ketone solvent may be distilled from the reaction mixture. In either case, it is preferred to wash the initial product at least once with water in order to remove any remaining solvent and/or catalyst and/or unreacted reactants, and especially unreacted oxirane compounds.

The product may then be applied to the polyamide or polyester fiber from an organic solvent such as acetone, methanol or dioxane. It is believed that the oligomeric product mixtures can be applied to fibers in an emulsion similar to the emulsion described in U.S. Pat. No. 4,192,754 Marshall et al., or in other emulsion systems such as those described in the other Marshall and Marshall et al. patents listed above. It is also believed that the compound may further be applied to the fiber along with other fiber treating agents, and especially spin finishes used to reduce friction of the fiber during processing.

Suitable fibers include poly(caproamide) (nylon 6), poly(hexamethylene diamine adipate) (nylon 66) and other polyamides of both the poly(amino acid) type and poly(diamine dicarboxylate) types such as poly(hexamethylene diamine sebacate) known as nylon 6,12. Also suitable are polyesters such as poly(ethylene terephthalate) (PET). Levels of application are not critical, with levels on a fluoride/fiber basis similar to the above patents being suitable (e.g. 0.075–0.25% fluoride).

Subsequent to fiber application, it is preferred that the treated fiber be annealed to improve the adherance of the treating agent to the fiber. Annealing temperatures for many surfactants such as those described in the Background section of this application are generally between about 80 and about 160° C.; but with the present products, the annealing temperature range is from about 40° C. to about 160° C. The oligomeric mixtures of the present invention are especially unusual in that fibers treated with the mixtures exhibit excellent soil resistance properties and retention of the properties, even though annealing temperatures as low as 40° C. to 50° C. are employed. However, in many preferred embodiments of this invention, the annealing step is conducted at temperatures between about 100° C. and about 140° C.

EXAMPLES

In performing the reactions described by Examples 1–13, a 500 mL or 250 mL 3-necked round bottom flask was fitted with a stirring bar, thermometer, water condenser, nitrogen inlet and vent. In each example, perfluoroalkylethanol refers to a mixture of fluorinated alcohols of the formula $CF_3CF_2(CF_2CF_2)_nCH_2CH_2OH$ with n=2, 3, 4 and 5. The fluorinated alcohols contained 2.1 meq OH/g.

EXAMPLE 1

Di-(perfluoroalkylethanol)-bis-(3-chloro-2-hydroxypropyl) tetraester of pyromellitic acid (40 g, 30.08 meq) was dissolved at 45° C. in dry N-methylpyrrolidone (35 mL). Pyromellitic dianhydride (3.28 g, 30.11 meq) was added and the reaction mixture was allowed to react for fifteen hours at 45° C. The temperature of the reaction mixture was raised to 55° C. Epichlorohydrin (7.05 mL, 90.24 meq) and triethylamine (0.13 mL) were added. The reaction mixture was then allowed to react for thirteen additional hours. Upon cooling to room temperature, the reaction mixture was then poured into two liters of well-stirred ice water (5° C.) to precipitate the product and stirred for 0.5 hours. The precipitate was washed three more times in a similar manner. The product was recovered by filtration and dried overnight at room temperature under vacuum. An off-white solid product weighing 34.7 g was recovered. The product had a surface energy of 10 dynes/cm as determined by the Zisman technique. Proton NMR confirmed the structural characteristics of the oligomeric product mixture.

EXAMPLE 2

Perfluoroalkylethanol (165.4 g, 347.34 meq), pyromellitic dianhydride (37.9 g, 347.92 meq) and N-methylpyrrolidone (160 mL) were added to a reaction flask to form a reaction mixture. The reaction mixture was heated to 45° C. and stirred for eighteen hours in order to complete the initial reaction. The temperature of the reaction mixture was raised to 55° C. and epichlorohydrin (81.5 mL, 1043.2 meq) and triethylamine (1.45 mL) were added to the reaction mixture. The reaction was continued for five additional hours. Pyromellitic dianhydride (19 g, 174.42 meq) was then added to the reaction mixture and the reaction was allowed to continue for sixteen hours. The reaction mixture containing the product was allowed to cool to room temperature and was poured into three liters of ice water (5° C.). The product was washed and recovered as in Example 1. The product (240.9 g) was a tan, tacky solid and had a surface energy of 12 dynes/cm as determined by the Zisman technique. The structural characteristics of the product were confirmed by proton NMR.

EXAMPLE 3

Perfluoroalkyethanol (159 g, 333.9 meq) pyromellitic dianhydride (36.4 g, 334.2 meq) and N-methylpyrrolidone (168 mL) were added to a reaction flask and reacted as in Example 2. Epichlorohydrin (78.3 mL, 1002.24 meq) and triethylamine (1.5 mL) were added to the reaction mixture and the reaction was allowed to continue for five additional hours. Pyromellitic dianhydride (21.8 g, 200.12 meq) was added to the reaction mixture and the reaction was completed as in Example 2. A tan solid product weighing 246.9 g was recovered via the procedure described in Example 1. The product had a surface tension of 12 dynes/cm as determined by the Zisman technique.

EXAMPLE 4

Using the procedures of Example 2, the following amount of reactants, catalyst and solvent were employed in order to produce an oligomeric mixture:

| | | | g |
|---|---|---|---|
| Perfluoroalkylethanol | 171.9 | g | 360.99 |
| Pyromellitic dianhydride (initial reaction) | 39.3 | g | 360.774 |
| N—methylpyrrolidone | 184.0 | mL | |
| Triethylamine | 1.5 | mL | |
| Epichlorohydrin | 84.7 | mL | 1084.16 |
| Pyromellitic dianhydride | 35.5 | g | 234.09 |

A tan solid product (277.6 g) having a surface energy of 12 dynes/cm was recovered. Structural characteristics were confirmed by proton NMR.

EXAMPLE 5

Perfluoroalkylethanol (160.3 g, 336.63 meq), pyromellitic dianydride (36.7 g, 336.91 meq), and N-methylpyrrolidone (160 mL) were added to a reaction flask to form a reaction mixture. The reaction mixture was reacted at a temperature of 45° C. for 23 hours. Epichlorohydrin (79 mL, 1011.2 meq) and triethylamine (1.4 mL) were added to the reaction mixture and the reaction was allowed to continue at 55° C. for a period of 9.5 hours. By titration with alcoholic potassium hydroxide, it was determined that 91.5% of the carboxyl groups had reacted. Pyromellitic dianhydride (18.4 g, 168.91 meq), epichlorohydrin (39.5 mL, 505.6 meq) and triethylamine (0.7 mL) were then added to the reaction mixture. The reaction was continued for an additional 9.5 hours. Titration indicated that essentially all of the carboxyls had reacted at this point. A product weighing 235.4 g was recovered as in Example 1. Proton NMR confirmed the desired structural characteristics.

EXAMPLE 6

Perfluoroalkylethanol (164.5 g, 345.45 meq), pyromellitic dianhydride (37.7 g, 346.09 meq) and N-methylpyrrolidone (166 mL) were added to a reaction flask to form a reaction mixture. The reaction mixture was allowed to react for 22 hours at 45° C. Epichlorohydrin (81 mL, 1036.8 meq) and triethylamine (1.44 mL) were added to the reaction mixture, and the reaction was continued at 60° C. for 7.5 hours. Utilizing the titration procedure described in Example 5, it was determined that 95% of the carboxyl groups had reacted. Pyromellitic dianhydride (18.8 g, 172.58 meq), epichlorohydrin (41.6 mL, 172.5 meq), and triethylamine (0.72 mL) were then added to the reaction mixture, and the reaction was continued for an additional six hours. Titration indicated that essentially all of the carboxyl groups had reacted. A product weighing 226.1 g was recovered as above. The product had a surface energy of 12 dynes/cm.

EXAMPLE 7

Perfluoroalkylethanol (162.7 g, 341.67 meq), pyromellitic dianhydride (37.2 g, 341.49 meq) and N-methylpyrrolidone (160 mL) were added to a reaction flask to form a reaction mixture. The reaction mixture was warmed to 45° C. and allowed to react for 23 hours. Epichlorohydrin (80.1 mL, 1025.28 meq) and triethylamine (1.42 mL) were added to the reaction mixture, and the reaction was continued at 65° C. for four hours. Titration in accordance with Example 5 indicated that 89.6% of the available carboxyl groups had reacted. Pyromellitic dianhydride (18.6 g, 170.75 meq), epichlorohydrin (40.0 mL, 512 meq) and triethylamine (0.71 mL) were added to the reaction mixture. The reaction was continued for six additional hours. Titration indicated that essentially all of the available carboxyl groups had reacted. A product weighing 266.9 g was recovered as in Example 1. The product had a surface tension of 15 dynes/cm as determined by the Zisman technique. Proton NMR confirmed the structural characteristics of the oligomeric product.

EXAMPLE 8

Perfluoroalkylethanol (163.3 g, 342.3 meq), pyromellitic dianhydride (37.4 g, 343.33 meq) and N-methylpyrrolidone (168 mL) were added to a reaction flask to form a reaction mixture. The reaction mixture was warmed to 45° C. and allowed to react for 21 hours. Epichlorohydrin (80.4 mL, 1029.12 meq) and triethylamine (1.43 mL) were then added to the reaction mixture. The reaction was then continued for 11.5 hours at 55° C. Titration in accordance with Example 5 indicated that 90.9% of the available carboxyls had reacted. Pyromellitic dianhyride (11.2 g, 102.82 meq), epichlorohydrin (24.1 mL, 308.48 meq) and triethylamine (0.43 mL) were then added to the reaction mixture. The reaction was continued for ten additional hours at 55° C. Titration indicated that essentially no unreacted carboxyl groups remained. A product weighing 274.6 g was recovered as in Example 1. Proton NMR confirmed the structural characteristics of the oligomeric product mixture.

EXAMPLE 9

Perfluoroalkylethanol (161.9 g, 339.99 meq), pyromellitic dianhydride (37.1 g, 340.58 meq) and N-methylpyrrolidone (162 mL) were added to a reaction flask to form a reaction mixture. The reaction mixture was warmed to 45° C. and allowed to react for 23 hours. Epichlorohydrin (79.8 mL, 1021.44 meq) and triethylamine (1.42 mL) were added to the reaction mixture, and the reaction was continued at 55° C. for ten hours. Titration in accordance with Example 5 indicated that 90% of the available carboxyl groups had reacted. Pyromellitic dianhydride (7.42 g, 68.12 meq), epichlorohydrin (16 mL, 204.8 meq) and triethylamine (0.28 mL) were added to the reaction mixture. The reaction was then continued for ten additional hours at 55° C. Titration indicated that essentially all carboxyl groups had reacted. A product weighing 195.9 g was recovered as in Example 1. Proton NMR confirmed the structural characteristics of the oligomeric product mixture.

EXAMPLE 10

Perfluoroalkylethanol (160.0 g, 336.0 meq), pyromellitic dianhydride (35.6 g, 326.5 meq) and N-methylpyrrolidone (59 mL) were added to a reaction flask to form a reaction mixture. The reaction mixture was warmed to 45° C. and allowed to react for 18.5 hours. Epichlorohydrin (78.8 mL, 1008.6 meq) and triethylamine (1.4 mL) were then added to the reaction mixture. The temperature of the reaction mixture was raised to 55° C., and the reaction mixture was allowed to react for 12 hours. Titration in accordance with Example 5 indicated that 90.8% of the carboxyls had been reacted. Pyromellitic dianhydride (14.2 g, 130.2 meq), epichlorohydrin (31.5 mL, 403.2 meq) and triethylamine (0.56 mL) were then added to the reaction mixture. The reaction was then continued for 9.5 additional hours at 55° C. Titration indicated that essentially no unreacted carboxyl groups remained. A product weighing 140 g was recovered as in Example 1. The product had a surface tension of 15 dynes/cm as determined by the Zisman technique. Proton NMR confirmed the structural characteristics of the oligomeric product.

COMPARATIVE EXAMPLE 11

Perfluoroalkylethanol (62.9 g, 132.09 meq), pyromellitic dianhydride (14.4 g, 132.19 meq) N-methylpyrrolidone (65 mL) and triethylamine (0.55 mL) were added to a reaction flask to form a reaction mixture. The reaction mixture was warmed to 45° C. and allowed to react for two hours. Epichlorohydrin (30.99 mL, 396.67 meq) was then added to the reaction mixture. The temperature of the reaction mixture was raised to 75° C., and the reaction was allowed to continue for five hours. Titration indicated that essentially all of the available carboxyl groups had reacted. A product weighing 69.6 g was recovered as in Example 1 with some difficulty. The product had a surface tension of 12 dynes/cm as determined by the Zisman technique. The structure of the single ring pyromellitate tetraester was confirmed by proton NMR. Thomas et al., copending commonly assigned application Ser. No. 350,544 disclosed that this material contained some materials of an oligomeric nature and that commercial preparations of this pyromellitate also contained some materials of an oligomeric nature.

EXAMPLE 12

Perfluoroalkylethanol (63.6 g, 133.56 meq), pyromellitic dianhydride (14.6 g, 134.03 meq), N-methylpyrrolidone (65 mL) and triethylamine (0.65 mL) were added to a reaction flask to form a reaction mixture. The reaction mixture was warmed to 45° C. and reacted for two hours. Epichlorohydrin (43.4 mL, 555.52 meq) was added to a reaction mixture, and the reaction mixture was reacted for two hours at 75° C. Pyromellitic dianhydride (7.3 g, 67.01 meq) was added and the reaction was continued at 75° C. for an additional five hours. It was necessary to wash the product using a Waring blender due to its soft consistency. A product weighing 70.3 g was obtained. The product had a surface tension of 8 dynes/cm as determined by the Zisman technique. Structural characteristics of the oligomeric product mixture were confirmed by proton NMR.

EXAMPLE 13

Perfluoroalkylethanol (157.1 g, 329.9 meq), pyromellitic dianhydride (34.7 g, 318.2 meq) and N-methylpyrrolidone (160 mL) were added to a reaction flask to form a reaction mixture. The reaction mixture was warmed to 45° C. and allowed to react for 23 hours. Epichlorohydrin (112.1 mL, 1434.88 meq), pyromellitic dianhydride (17.4 g, 159.6 meq) and triethylamine (2.0 mL) were then added to the reaction mixture. The temperature of the reaction mixture was raised to 65° C., and the reaction mixture was allowed to react for 7 hours. Titration in accordance with Example 5 indicated that 99.1% of the available carboxyl moieties had reacted. A product weighing 253.0 g was recovered as in Example 1. The product had a surface tension of 14 dynes/cm as determined by the Zisman technique. Proton NMR confirmed the structural characteristics of the oligomeric product.

EXAMPLE 14

Performance Evaluation

Solutions were prepared from the products of Examples 1–13 of 0.25 g of each product in 100 mL acetone. It will be appreciated that the products of Examples 1–10 and 12–13 are oligomeric mixtures and that the product of Example 11 is a pyromellitate having a structure similar to the pyromellitates of Mares et al., Oxenrider et al., and Oxenrider as described in the Background section of this application. Therefore, Example 11 is a comparative example, and it is labeled as C-11 in Tables I–XII. Swatches of polyamide and polyester fabrics were dipped in the solutions, air dried for 1—3 hours, and then annealed for 30 minutes in a circulating oven at a selected temperature. These swatches were then tested for oil repellency by the procedures of AATC Test No. 118–1966 initially and after being subjected to a number of laundry cycles. The results are displayed in Tables I–XII below:

TABLE I

| Laundry Cycles | Fiber Nylon 6 Anneal Temp. 100° C. Example 1 | 2 | 3 | 4 | 5 | 6 | 7 | 8 | 9 | 10 | C-11 | 12 | 13 |
|---|---|---|---|---|---|---|---|---|---|---|---|---|---|
| 0 | 7 | 7 | 6 | 6 | 7 | 6 | 6 | 7 | 7 | 7 | 7 | 7 | 7 |
| 1 | 6 | 7 | 6 | 6 | 6 | 6 | 6 | 7 | 7 | 6 | 6 | 7 | 6 |
| 2 | 6 | 7 | 6 | 6 | 6 | 6 | 6 | 6 | 7 | 6 | 6 | 6 | 6 |

TABLE I-continued

| Laundry Cycles | Fiber Nylon 6 Anneal Temp. 100° C. Example 1 | 2 | 3 | 4 | 5 | 6 | 7 | 8 | 9 | 10 | C-11 | 12 | 13 |
|---|---|---|---|---|---|---|---|---|---|---|---|---|---|
| 3 | 6 | 6 | 6 | 6 | 6 | 6 | 6 | 6 | 6 | 6 | 6 | 6 | 6 |
| 4 | 6 | 6 | 5 | 6 | 6 | 6 | 6 | 6 | 6 | 5 | 6 | 6 | 5 |
| 5 | 5 | 6 | 5 | 5 | 6 | 6 | 5 | 6 | 6 | 5 | 6 | 5 | 5 |
| 6 | 5 | 6 | 5 | 5 | 5 | 5 | 5 | 6 | 6 | 5 | 6 | 5 | 4 |
| 7 | 5 | 6 | 5 | 4 | 5 | 5 | 5 | 5 | 6 | 4 | 3 | 5 | 4 |
| 8 | 5 | 5 | 4 | 4 | 4 | 5 | 5 | 5 | 6 | 4 | | 5 | 3 |
| 9 | 4 | 5 | 4 | 3 | 4 | 4 | 4 | 4 | 5 | 4 | | 4 | |
| 10 | 2 | 4 | 3 | | 4 | 4 | 4 | 3 | 5 | 3 | | 3 | |
| 11 | | 4 | | | 3 | 3 | 3 | | 4 | | | | |
| 12 | | 4 | | | | | | | 2 | | | | |
| 13 | | 4 | | | | | | | | | | | |
| 14 | | 3 | | | | | | | | | | | |

TABLE II

| Laundry Cycles | Fiber Nylon 6 Anneal Temp. 120° C. Example 1 | 2 | 3 | 4 | 5 | 6 | 7 | 8 | 9 | 10 | C-11 | 12 | 13 |
|---|---|---|---|---|---|---|---|---|---|---|---|---|---|
| 0 | 6 | 6 | 6 | 6 | 7 | 6 | 6 | 7 | 7 | 7 | 6 | 6 | 7 |
| 1 | 6 | 6 | 6 | 6 | 6 | 6 | 6 | 7 | 7 | 6 | 6 | 6 | 6 |
| 2 | 6 | 6 | 6 | 6 | 6 | 6 | 6 | 6 | 7 | 6 | 6 | 6 | 6 |
| 3 | 6 | 6 | 6 | 6 | 6 | 6 | 5 | 6 | 6 | 6 | 6 | 6 | 5 |
| 4 | 6 | 6 | 5 | 6 | 5 | 5 | 5 | 6 | 6 | 5 | 6 | 5 | 5 |
| 5 | 5 | 5 | 5 | 5 | 5 | 5 | 5 | 6 | 6 | 5 | 6 | 5 | 5 |
| 6 | 5 | 5 | 5 | 5 | 5 | 5 | 5 | 5 | 6 | 5 | 6 | 5 | 4 |
| 7 | 5 | 5 | 5 | 5 | 5 | 4 | 4 | 4 | 6 | 4 | 5 | 4 | 4 |
| 8 | 5 | 5 | 4 | 4 | 4 | 4 | 4 | 4 | 5 | 4 | 5 | 4 | 3 |
| 9 | 4 | 4 | 4 | 4 | 4 | 4 | 4 | 4 | 5 | 3 | 5 | 4 | |
| 10 | 4 | 4 | 3 | 3 | 3 | 3 | 3 | 3 | 5 | | 3 | 2 | |
| 11 | 2 | 4 | | | | | | | 4 | | | | |
| 12 | | 4 | | | | | | | 3 | | | | |
| 13 | | 3 | | | | | | | | | | | |

TABLE III

| Laundry Cycles | Fiber Nylon 6 Anneal Temp. 140° C. Example 1 | 2 | 3 | 4 | 5 | 6 | 7 | 8 | 9 | 10 | C-11 | 12 | 13 |
|---|---|---|---|---|---|---|---|---|---|---|---|---|---|
| 0 | 6 | 6 | 6 | 6 | 6 | 6 | 6 | 7 | 7 | 6 | 7 | 6 | 6 |
| 1 | 6 | 6 | 6 | 6 | 6 | 6 | 6 | 6 | 7 | 6 | 6 | 6 | 6 |
| 2 | 6 | 6 | 6 | 6 | 6 | 6 | 6 | 6 | 6 | 6 | 6 | 6 | 6 |
| 3 | 6 | 6 | 5 | 6 | 5 | 5 | 5 | 5 | 6 | 5 | 6 | 5 | 5 |
| 4 | 5 | 6 | 5 | 5 | 5 | 5 | 5 | 5 | 6 | 4 | 6 | 5 | 5 |
| 5 | 5 | 5 | 4 | 4 | 4 | 4 | 4 | 5 | 5 | 3 | 6 | 5 | 4 |
| 6 | 4 | 5 | 4 | 4 | 4 | 4 | 4 | 4 | 5 | | 6 | 4 | 4 |
| 7 | 4 | 4 | 4 | 3 | 2 | 3 | 3 | 2 | 5 | | 5 | 4 | 3 |
| 8 | 2 | 3 | 3 | | | | | | 4 | | 5 | 4 | |
| 9 | | | | | | | | | 4 | | 4 | 3 | |
| 10 | | | | | | | | | 4 | | 2 | | |

TABLE IV

| Laundry Cycles | Fiber Nylon 6 Anneal Temp. 155° C. Example 1 | 2 | 3 | 4 | 5 | 6 | 7 | 8 | 9 | 10 | C-11 | 12 | 13 |
|---|---|---|---|---|---|---|---|---|---|---|---|---|---|
| 0 | 6 | 6 | 6 | 6 | 6 | 6 | 6 | 7 | 7 | 6 | 7 | 6 | 6 |
| 1 | 6 | 6 | 6 | 6 | 6 | 6 | 6 | 6 | 7 | 6 | 6 | 6 | 6 |
| 2 | 6 | 6 | 6 | 6 | 6 | 6 | 6 | 6 | 6 | 6 | 6 | 6 | 5 |
| 3 | 6 | 6 | 5 | 6 | 6 | 5 | 5 | 5 | 6 | 4 | 6 | 5 | 5 |
| 4 | 5 | 6 | 5 | 5 | 5 | 5 | 5 | 5 | 5 | 4 | 6 | 5 | 5 |
| 5 | 4 | 5 | 5 | 4 | 4 | 4 | 4 | 5 | 5 | 2 | 6 | 4 | 4 |
| 6 | 4 | 4 | 4 | 4 | 4 | 3 | 4 | 4 | 5 | | 6 | 4 | 3 |
| 7 | 4 | 3 | 3 | 3 | 3 | | 3 | 4 | 4 | | 5 | 4 | |
| 8 | 2 | | | 2 | | | | 4 | 4 | | 4 | 4 | |
| 9 | | | | | | | | 2 | 3 | | 2 | 3 | |

TABLE V

| Laundry Cycles | Fiber Nylon 6,6 Anneal Temp. 100° C. Example 1 | 2 | 3 | 4 | 5 | 6 | 7 | 8 | 9 | 10 | C-11 | 12 | 13 |
|---|---|---|---|---|---|---|---|---|---|---|---|---|---|
| 0 | 6 | 6 | 6 | 6 | 6 | 6 | 6 | 7 | 7 | 6 | 6 | 6 | 7 |
| 1 | 6 | 6 | 6 | 6 | 6 | 6 | 6 | 6 | 7 | 6 | 6 | 6 | 6 |
| 2 | 6 | 6 | 6 | 6 | 6 | 6 | 6 | 6 | 6 | 6 | 6 | 6 | 6 |
| 3 | 6 | 6 | 6 | 6 | 6 | 6 | 6 | 5 | 6 | 6 | 5 | 6 | 5 |
| 4 | 6 | 6 | 6 | 6 | 6 | 6 | 6 | 5 | 6 | 5 | 4 | 5 | 4 |
| 5 | 5 | 6 | 6 | 6 | 6 | 6 | 6 | 5 | 5 | 4 | 4 | 5 | 4 |
| 6 | 5 | 5 | 5 | 5 | 5 | 5 | 5 | 5 | 5 | 4 | 2 | 5 | 4 |
| 7 | 5 | 4 | 4 | 5 | 5 | 5 | 4 | 5 | 4 | 3 | | 5 | 3 |
| 8 | 4 | 4 | 4 | 4 | 4 | 4 | 3 | 5 | 4 | | | 4 | |
| 9 | 4 | 3 | 4 | 4 | 2 | 3 | | 5 | 4 | | | 4 | |
| 10 | 2 | | 4 | 4 | | | | 4 | 3 | | | 4 | |
| 11 | | | 3 | 3 | | | | 3 | | | | 3 | |

TABLE VI

| Laundry Cycles | Fiber Nylon 6,6 Anneal Temp. 120° C. Example 1 | 2 | 3 | 4 | 5 | 6 | 7 | 8 | 9 | 10 | C-11 | 12 | 13 |
|---|---|---|---|---|---|---|---|---|---|---|---|---|---|
| 0 | 6 | 6 | 6 | 6 | 6 | 6 | 6 | 7 | 7 | 6 | 6 | 6 | 6 |
| 1 | 6 | 6 | 6 | 6 | 6 | 6 | 6 | 6 | 7 | 6 | 6 | 6 | 6 |
| 2 | 6 | 6 | 6 | 6 | 6 | 6 | 6 | 6 | 6 | 6 | 6 | 6 | 6 |
| 3 | 6 | 6 | 6 | 6 | 6 | 6 | 6 | 6 | 6 | 6 | 6 | 6 | 5 |
| 4 | 6 | 6 | 6 | 6 | 6 | 6 | 6 | 6 | 6 | 5 | 5 | 5 | 4 |
| 5 | 5 | 5 | 5 | 5 | 6 | 6 | 6 | 5 | 5 | 4 | 4 | 5 | 4 |
| 6 | 5 | 5 | 5 | 5 | 5 | 5 | 5 | 5 | 5 | 4 | 4 | 5 | 4 |
| 7 | 5 | 5 | 5 | 5 | 5 | 5 | 4 | 5 | 4 | 4 | 2 | 5 | 3 |
| 8 | 4 | 5 | 4 | 4 | 4 | 4 | 4 | 5 | 4 | 4 | | 4 | |
| 9 | 3 | 3 | 4 | 4 | 4 | 4 | 4 | 5 | 3 | 3 | | 4 | |
| 10 | | | 4 | 4 | 2 | 4 | 3 | 4 | | | | 4 | |
| 11 | | | 3 | 3 | | 3 | | 3 | | | | 4 | |
| 12 | | | | | | | | | | | | 3 | |

TABLE VII

| Laundry Cycles | Fiber Nylon 6,6 Anneal Temp. 140° C. Example 1 | 2 | 3 | 4 | 5 | 6 | 7 | 8 | 9 | 10 | C-11 | 12 | 13 |
|---|---|---|---|---|---|---|---|---|---|---|---|---|---|
| 0 | 6 | 6 | 6 | 6 | 6 | 6 | 6 | 7 | 7 | 6 | 6 | 6 | 6 |
| 1 | 6 | 6 | 6 | 6 | 6 | 6 | 6 | 6 | 7 | 6 | 6 | 6 | 6 |
| 2 | 6 | 6 | 6 | 6 | 6 | 6 | 6 | 6 | 6 | 6 | 6 | 6 | 6 |
| 3 | 6 | 6 | 6 | 6 | 6 | 6 | 6 | 6 | 6 | 6 | 6 | 6 | 5 |
| 4 | 6 | 6 | 6 | 6 | 6 | 6 | 6 | 6 | 6 | 5 | 6 | 5 | 4 |
| 5 | 5 | 6 | 5 | 5 | 5 | 5 | 5 | 5 | 5 | 4 | 5 | 5 | 4 |
| 6 | 5 | 5 | 5 | 5 | 5 | 5 | 5 | 5 | 5 | 4 | 5 | 5 | 4 |
| 7 | 5 | 5 | 5 | 5 | 5 | 5 | 4 | 5 | 4 | 4 | 4 | 5 | 3 |
| 8 | 5 | 5 | 4 | 4 | 4 | 4 | 4 | 4 | 4 | 3 | 4 | 5 | |
| 9 | 5 | 4 | 4 | 4 | 4 | 4 | 4 | 4 | 4 | | 2 | 5 | |
| 10 | 5 | 4 | 4 | 4 | 2 | 4 | 4 | 4 | 3 | | | 4 | |
| 11 | 4 | 4 | 4 | 4 | | 3 | 3 | 3 | | | | 4 | |
| 12 | 3 | 3 | 3 | | | | | | | | | 4 | |
| 13 | | | | | | | | | | | | 3 | |

TABLE VIII

| Laundry Cycles | Fiber Nylon 6,6 Anneal Temp. 155° C. Example 1 | 2 | 3 | 4 | 5 | 6 | 7 | 8 | 9 | 10 | C-11 | 12 | 13 |
|---|---|---|---|---|---|---|---|---|---|---|---|---|---|
| 0 | 6 | 6 | 6 | 6 | 6 | 6 | 6 | 7 | 7 | 6 | 6 | 6 | 6 |
| 1 | 6 | 6 | 6 | 6 | 6 | 6 | 6 | 6 | 7 | 6 | 6 | 6 | 6 |
| 2 | 6 | 6 | 6 | 6 | 6 | 6 | 6 | 6 | 6 | 6 | 6 | 6 | 6 |
| 3 | 6 | 6 | 6 | 6 | 6 | 6 | 5 | 6 | 6 | 5 | 6 | 6 | 5 |
| 4 | 6 | 6 | 6 | 6 | 5 | 5 | 5 | 6 | 6 | 5 | 6 | 5 | 4 |
| 5 | 5 | 6 | 5 | 5 | 5 | 5 | 5 | 5 | 5 | 4 | 6 | 5 | 4 |
| 6 | 5 | 5 | 5 | 5 | 5 | 5 | 5 | 5 | 5 | 4 | 5 | 5 | 4 |
| 7 | 5 | 5 | 5 | 5 | 5 | 5 | 4 | 5 | 4 | 3 | 5 | 5 | 3 |
| 8 | 5 | 5 | 4 | 4 | 4 | 4 | 3 | 4 | 4 | | 5 | 5 | |
| 9 | 5 | 4 | 4 | 4 | 4 | 4 | | 4 | 4 | | 5 | 5 | |
| 10 | 4 | 4 | 3 | 4 | 2 | 4 | | 4 | 3 | | 4 | 4 | |
| 11 | 4 | 4 | | 3 | | 3 | | 3 | | | 2 | 4 | |

TABLE VIII-continued

| Laundry Cycles | Fiber Nylon 6,6 Anneal Temp. 155° C. Example 1 | 2 | 3 | 4 | 5 | 6 | 7 | 8 | 9 | 10 | C-11 | 12 | 13 |
|---|---|---|---|---|---|---|---|---|---|---|---|---|---|
| 12 | 4 | 3 | | | | | | | | | | 4 | |
| 13 | 4 | | | | | | | | | | | 3 | |
| 14 | 3 | | | | | | | | | | | | |

TABLE IX

| Laundry Cycles | Fiber Poly(ethylene terephthalate) Anneal Temp. 100° C. Example 1 | 2 | 3 | 4 | 5 | 6 | 7 | 8 | 9 | 10 | C-11 | 12 | 13 |
|---|---|---|---|---|---|---|---|---|---|---|---|---|---|
| 0 | 7 | 6 | 6 | 6 | 6 | 6 | 6 | 7 | 7 | 6 | 7 | 6 | 7 |
| 1 | 6 | 6 | 6 | 6 | 6 | 6 | 6 | 7 | 7 | 6 | 6 | 6 | 6 |
| 2 | 6 | 6 | 6 | 6 | 6 | 6 | 6 | 6 | 6 | 6 | 6 | 6 | 6 |
| 3 | 6 | 6 | 6 | 6 | 6 | 6 | 6 | 6 | 6 | 6 | 6 | 6 | 6 |
| 4 | 6 | 6 | 6 | 5 | 6 | 6 | 6 | 6 | 6 | 6 | 6 | 6 | 5 |
| 5 | 5 | 6 | 5 | 5 | 6 | 6 | 6 | 6 | 6 | 5 | 6 | 6 | 5 |
| 6 | 5 | 5 | 5 | 5 | 5 | 5 | 5 | 6 | 6 | 5 | 6 | 5 | 5 |
| 7 | 5 | 5 | 5 | 5 | 5 | 5 | 5 | 5 | 6 | 5 | 5 | 5 | 4 |
| 8 | 5 | 4 | 5 | 4 | 5 | 5 | 5 | 5 | 5 | 5 | 5 | 5 | 3 |
| 9 | 5 | 4 | 4 | 4 | 4 | 5 | 4 | 5 | 5 | 5 | 4 | 5 | |
| 10 | 4 | 4 | 4 | 4 | 4 | 5 | 4 | 4 | 5 | 5 | 3 | 5 | |
| 11 | 4 | 4 | 4 | 4 | 4 | 5 | 4 | 4 | 4 | 5 | | 5 | |
| 12 | 4 | 3 | 4 | | 4 | 4 | 4 | 4 | 4 | 4 | | 4 | |
| 13 | 3 | | 3 | | 4 | 4 | 4 | 3 | 4 | 4 | | 4 | |
| 14 | | | | | 4 | 3 | 4 | | 3 | 4 | | 4 | |
| 15 | | | | | 4 | | 3 | | | 3 | | 4 | |
| 16 | | | | | 2 | | | | | | | 3 | |

TABLE X

| Laundry Cycles | Fiber Poly(ethylene terephthalate) Anneal Temp. 120° C. Example 1 | 2 | 3 | 4 | 5 | 6 | 7 | 8 | 9 | 10 | C-11 | 12 | 13 |
|---|---|---|---|---|---|---|---|---|---|---|---|---|---|
| 0 | 6 | 6 | 6 | 6 | 6 | 6 | 6 | 7 | 7 | 6 | 7 | 6 | 7 |
| 1 | 6 | 6 | 6 | 6 | 6 | 6 | 6 | 6 | 7 | 6 | 6 | 6 | 6 |
| 2 | 6 | 6 | 6 | 6 | 6 | 6 | 6 | 6 | 6 | 6 | 6 | 6 | 6 |
| 3 | 6 | 6 | 6 | 5 | 6 | 6 | 6 | 6 | 6 | 6 | 6 | 6 | 5 |
| 4 | 6 | 6 | 6 | 5 | 6 | 6 | 5 | 6 | 6 | 6 | 6 | 5 | 5 |
| 5 | 6 | 5 | 5 | 5 | 5 | 5 | 5 | 6 | 6 | 5 | 6 | 5 | 5 |
| 6 | 5 | 5 | 5 | 5 | 5 | 5 | 5 | 6 | 6 | 5 | 6 | 5 | 5 |
| 7 | 5 | 5 | 5 | 4 | 5 | 5 | 5 | 5 | 6 | 5 | 5 | 5 | 4 |
| 8 | 5 | 4 | 5 | 4 | 5 | 5 | 5 | 5 | 5 | 5 | 5 | 5 | 4 |
| 9 | 5 | 4 | 5 | 3 | 4 | 5 | 4 | 5 | 5 | 5 | 5 | 5 | 4 |
| 10 | 4 | 4 | 4 | | 4 | 5 | 4 | 4 | 5 | 4 | 4 | 4 | 3 |
| 11 | 4 | 4 | 4 | | 4 | 4 | 4 | 4 | 5 | 4 | 3 | 4 | |
| 12 | 4 | 3 | 4 | | 4 | 4 | 3 | 4 | 4 | 4 | | 4 | |
| 13 | 3 | | 4 | | 4 | 4 | | 4 | 4 | 4 | | 4 | |
| 14 | | | 4 | | 4 | 4 | | 4 | 4 | 3 | | 4 | |
| 15 | | | 4 | | 4 | 3 | | 3 | 3 | | | 4 | |
| 16 | | | 3 | | 4 | | | | | | | 4 | |
| 17 | | | | | 3 | | | | | | | 3 | |

TABLE XI

| Laundry Cycles | Fiber Poly(ethylene terephthalate) Anneal Temp. 140° C. Example 1 | 2 | 3 | 4 | 5 | 6 | 7 | 8 | 9 | 10 | C-11 | 12 | 13 |
|---|---|---|---|---|---|---|---|---|---|---|---|---|---|
| 0 | 6 | 6 | 6 | 6 | 6 | 6 | 6 | 7 | 7 | 6 | 7 | 6 | 6 |
| 1 | 6 | 6 | 6 | 6 | 6 | 6 | 6 | 6 | 7 | 6 | 6 | 6 | 6 |
| 2 | 6 | 6 | 6 | 6 | 6 | 6 | 6 | 6 | 6 | 6 | 6 | 6 | 6 |
| 3 | 6 | 6 | 5 | 5 | 6 | 6 | 6 | 6 | 6 | 6 | 6 | 6 | 5 |
| 4 | 6 | 6 | 5 | 5 | 6 | 5 | 5 | 6 | 6 | 5 | 6 | 5 | 5 |
| 5 | 6 | 5 | 5 | 5 | 5 | 5 | 5 | 6 | 6 | 5 | 6 | 5 | 5 |
| 6 | 5 | 5 | 5 | 5 | 5 | 5 | 5 | 6 | 6 | 5 | 6 | 5 | 5 |
| 7 | 5 | 5 | 5 | 5 | 5 | 5 | 5 | 5 | 5 | 5 | 6 | 5 | 4 |
| 8 | 5 | 5 | 5 | 5 | 5 | 5 | 5 | 5 | 5 | 5 | 5 | 5 | 4 |
| 9 | 5 | 5 | 5 | 5 | 4 | 5 | 4 | 5 | 5 | 5 | 5 | 5 | 4 |
| 10 | 5 | 5 | 4 | 4 | 4 | 5 | 4 | 4 | 5 | 5 | 4 | 4 | 3 |
| 11 | 4 | 5 | 4 | 4 | 4 | 4 | 4 | 4 | 5 | 5 | 4 | 4 | |
| 12 | 4 | 4 | 4 | 4 | 4 | 4 | 4 | 4 | 4 | 4 | 4 | 4 | |

TABLE XI-continued

| Laundry Cycles | Fiber Poly(ethylene terephthalate) Anneal Temp. 140° C. Example 1 | 2 | 3 | 4 | 5 | 6 | 7 | 8 | 9 | 10 | C-11 | 12 | 13 |
|---|---|---|---|---|---|---|---|---|---|---|---|---|---|
| 13 | 4 | 4 | 4 | 4 | 4 | 4 | 4 | 4 | 4 | 4 | 3 | 4 | |
| 14 | 4 | 4 | 4 | 4 | 4 | 4 | 3 | 4 | 4 | 3 | | 4 | |
| 15 | 4 | 4 | 3 | 3 | 4 | 4 | | 3 | 4 | | | 4 | |
| 16 | 4 | 3 | | | 3 | 3 | | | 3 | | | 4 | |
| 17 | 4 | | | | | | | | | | | 3 | |
| 18 | 4 | | | | | | | | | | | | |
| 19 | 4 | | | | | | | | | | | | |
| 20 | 4 | | | | | | | | | | | | |
| 21 | 3 | | | | | | | | | | | | |

TABLE XII

| Laundry Cycles | Fiber Poly(ethylene terephthalate) Anneal Temp. 155° C. Example 1 | 2 | 3 | 4 | 5 | 6 | 7 | 8 | 9 | 10 | C-11 | 12 | 13 |
|---|---|---|---|---|---|---|---|---|---|---|---|---|---|
| 0 | 6 | 6 | 6 | 6 | 6 | 6 | 6 | 7 | 7 | 6 | 7 | 6 | 6 |
| 1 | 6 | 6 | 6 | 6 | 6 | 6 | 6 | 6 | 7 | 6 | 6 | 6 | 6 |
| 2 | 6 | 6 | 6 | 5 | 6 | 6 | 5 | 6 | 6 | 6 | 6 | 6 | 5 |
| 3 | 6 | 6 | 6 | 5 | 5 | 5 | 5 | 6 | 6 | 5 | 6 | 6 | 5 |
| 4 | 6 | 6 | 5 | 5 | 5 | 5 | 5 | 6 | 6 | 5 | 6 | 5 | 5 |
| 5 | 5 | 6 | 5 | 5 | 5 | 5 | 5 | 6 | 6 | 5 | 6 | 5 | 4 |
| 6 | 5 | 5 | 5 | 5 | 5 | 5 | 5 | 5 | 6 | 5 | 6 | 5 | 4 |
| 7 | 5 | 5 | 5 | 5 | 5 | 5 | 5 | 5 | 5 | 4 | 6 | 5 | 4 |
| 8 | 5 | 5 | 5 | 4 | 5 | 5 | 5 | 5 | 5 | 4 | 5 | 5 | 4 |
| 9 | 5 | 5 | 4 | 4 | 4 | 5 | 4 | 5 | 5 | 4 | 5 | 5 | 4 |
| 10 | 5 | 5 | 4 | 4 | 4 | 4 | 4 | 4 | 5 | 4 | 4 | 4 | 3 |
| 11 | 5 | 5 | 4 | 4 | 4 | 4 | 4 | 4 | 5 | 4 | 4 | 4 | |
| 12 | 5 | 4 | 4 | 4 | 4 | 4 | 4 | 4 | 4 | 4 | 4 | 4 | |
| 13 | 5 | 4 | 4 | 3 | 4 | 4 | 3 | 4 | 4 | 4 | 3 | 4 | |
| 14 | 5 | 4 | 3 | | 4 | 4 | | 4 | 4 | 4 | | 4 | |
| 15 | 4 | 4 | | | 4 | 3 | | 4 | 4 | 3 | | 4 | |
| 16 | 4 | 4 | | | 4 | | | 3 | 3 | | | 3 | |
| 17 | 4 | 3 | | | 3 | | | | | | | | |
| 18 | 4 | | | | | | | | | | | | |
| 19 | 4 | | | | | | | | | | | | |
| 20 | 4 | | | | | | | | | | | | |
| 21 | 4 | | | | | | | | | | | | |
| 22 | 2 | | | | | | | | | | | | |

The results of Example 14 as illustrated by Tables I–XII indicate that the oligomeric mixtures of the present invention are highly effective surface modifiers. An oil repellency of 5 after 5 laundry cycles is generally considered an excellent rating. The oligomers of this invention achieved an oil repellency of 5 after 5 laundry cycles in every instance except when they were applied to Nylon 6 fibers and annealed at 140° C. or 155° C. (see Tables III and IV). In many cases, fibers treated with the oligomeric mixtures of this invention had an oil repellency rating of 5 after 6 or more cycles. Furthermore, the oligomeric mixtures outperformed the comparative pyromellitate monomer of Example 11 in all cases except the cases where Nylon 6 was annealed at 140° C. and 150° C.

EXAMPLE 15

Low Temperature Annealing Performances Evaluation

Utilizing the procedures employed in Example 14, fibers treated with the products of Examples 6, 7, and 11 were annealed at temperatures from 50° C.–90° C. and then tested for oil repellency. As in Example 14, the product of Example 11 was used for comparative purposes. The results are illustrated in Table XIII.

TABLE XIII

| Laundry Cycles | Fibers: Nylon 6, Anneal Temp 50° C. Example 6 | 7 | C-11 | Nylon 6, Anneal Temp 60° C. 6 | 7 | C-11 | Nylon 6, Anneal Temp 70° C. 6 | 7 | C-11 | Nylon 6, Anneal Temp 90° C. 6 | 7 | C-11 |
|---|---|---|---|---|---|---|---|---|---|---|---|---|
| 0 | 7 | 7 | 7 | 7 | 7 | 7 | 7 | 7 | 7 | 7 | 7 | 7 |
| 1 | 6 | 6 | 4 | 6 | 6 | 4 | 6 | 6 | 6 | 6 | 6 | 5 |
| 2 | 6 | 6 | 2 | 6 | 6 | 2 | 6 | 6 | 2 | 6 | 6 | 2 |
| 3 | 5 | 6 | | 6 | 6 | | 6 | 6 | | 6 | 6 | |
| 4 | 5 | 6 | | 5 | 6 | | 6 | 6 | | 6 | 6 | |
| 5 | 4 | 6 | | 5 | 5 | | 5 | 6 | | 6 | 6 | |
| 6 | 4 | 5 | | 5 | 5 | | 5 | 5 | | 5 | 5 | |
| 7 | 4 | 5 | | 4 | 5 | | 4 | 5 | | 4 | 5 | |
| 8 | 3 | 4 | | 3 | 4 | | 4 | 4 | | 4 | 4 | |
| 9 | | 4 | | | 4 | | 4 | 4 | | 4 | 4 | |
| 10 | | 3 | | | 2 | | 3 | 2 | | 3 | 3 | |

The above results in Table XIII clearly illustrate that fibers treated with the oligomeric mixtures of this invention which are annealed at low temperatures will have desirable soil resistance properties. On the other hand, Table XIII indicates that fibers treated with the pyromellitate monomer of comparative Example 11 did not achieve a satisfactory oil repellency rating when said fibers were annealed at low temperatures.

We claim:

1. A process for the production of an organic mixture useful as a fiber surface modifying agent wherein said mixture comprises oligomeric compounds and wherein said process comprises:

(a) reacting pyromellitic dianhydride with fluorinated alcohol at a mole ratio of about two moles of fluorinated alcohol per mole of pyromellitic dianhydride to produce a pyromellitate having two fluorinated ester moieties and two carboxylic acid moieties;

(b) reacting said pyromellitate of step (a) with an excess of an oxirane compound selected from the group consisting of epichlorohydrin, epibromohydrin, and propylene oxide in the presence of additional pyromellitic dianhydride to produce said organic mixture comprising oligomeric compounds; wherein said oxirane compounds react with said carboxylic acid moieties to produce an ester having a primary or secondary alcohol, and wherein said alcohol reacts with said additional pyromellitic dianhydride to produce ester-linking moieties and carboxylic acid moieties capable of reacting with said oxirane compound to produce additional esters having primary or secondary alcohols.

2. A process according to claim 1 wherein said excess pyromellitic dianhydride is added to a reaction medium in said step (b) when about 50% to about 100% of the carboxylic acid moieties have been esterified.

3. A process according to claim 2 wherein said excess pyromellitic dianhydride is added to a reaction medium in said step (b) when about 85% to about 95% of the carboxylic acid moieties have been esterified.

4. A process according to claim 1 wherein said additional pyromellitic dianhydride is added to a reaction medium in said step (b) simultaneously with the oxirane compound.

5. The process of claim 1 or 2 or 3 or 4 wherein said fluorinated alcohol is of the formula: $CF_3(CF_2)_pR'OH$ wherein R′ is alkylene of 2–6 carbons and p is an integer of 3–15.

6. The process of claim 5 wherein said fluorinated alcohol is a mixture of compounds of the formula $CF_3CF_2(CF_2CF_2)_nCH_2CH_2OH$ with n being from 1 to 6.

7. The process of claim 6 wherein n is from 2 to 5.

8. The process of claim 7 conducted in N-methylpyrrolidone as solvent.

9. The process of claim 7 conducted in an aliphatic ester solvent having a boiling point less than about 150° C.

10. The oligomer-containing mixture produced by the process of claims 1 or 2 or 3 or 4.

11. A method of treating a polyamide or polyester fiber which comprises applying to the fiber the oligomer-containing mixture of claim 10 and annealing the treated fiber at a temperature between about 40° C. and about 160° C.

12. The method of claim 11 wherein the annealing is conducted at a temperature between about 100° C. and 140° C.

13. A polyamide fiber having applied thereto the oligomer-containing mixture of claim 10.

14. A polyester fiber having applied thereto the oligomer-containing mixture of claim 10.

15. A process according to claim 1 or 2 or 3 or 4 wherein said step (b) is conducted at a temperature between about 20° C. and about 80° C.

16. A process according to claim 15 wherein said temperature is about 55° C.

* * * * *